US010189059B2

(12) United States Patent
Mainzer et al.

(10) Patent No.: US 10,189,059 B2
(45) Date of Patent: Jan. 29, 2019

(54) DEVICES FOR CROSS BORE SAFEGUARD DURING SEWER SYSTEM CLEANOUTS

(71) Applicants: Jeff Mainzer, Cary, IL (US); Douglas A. Staebler, Oakton, VA (US)

(72) Inventors: Jeff Mainzer, Cary, IL (US); Douglas A. Staebler, Oakton, VA (US)

(73) Assignees: Gas Technology Institute, Des Plaines, IL (US); Washington Gas Light Company, Springfield, VA (US)

( * ) Notice: Subject to any disclaimer, the term of this patent is extended or adjusted under 35 U.S.C. 154(b) by 566 days.

(21) Appl. No.: 14/827,948

(22) Filed: Aug. 17, 2015

(65) Prior Publication Data

US 2017/0051494 A1 Feb. 23, 2017

(51) Int. Cl.

| | |
|---|---|
| ***E03F 9/00*** | (2006.01) |
| ***B08B 9/04*** | (2006.01) |
| ***B08B 9/043*** | (2006.01) |
| ***B08B 9/045*** | (2006.01) |

(52) U.S. Cl.

CPC ..... *B08B 9/04* (2013.01); *B08B 9/043* (2013.01); *B08B 9/045* (2013.01); *E03F 9/00* (2013.01); *E03F 9/002* (2013.01); *E03F 9/005* (2013.01)

(58) Field of Classification Search

CPC ..... E03F 9/005; E03F 5/042; B08B 9/04
USPC ..... 137/242, 244, 245, 245.5
See application file for complete search history.

(56) References Cited

U.S. PATENT DOCUMENTS

| | | | | |
|---|---|---|---|---|
| 2,176,553 | A * | 10/1939 | Walz et al. | E03C 1/302 15/104.05 |
| 5,038,829 | A * | 8/1991 | Panella | F16L 55/115 138/89 |
| 5,687,761 | A | 11/1997 | Langes | |
| 6,516,832 | B1 * | 2/2003 | Myers | E03B 7/003 138/93 |
| 8,286,275 | B2 * | 10/2012 | Kipp | E03C 1/12 137/245.5 |
| 9,725,894 | B2 * | 8/2017 | Caux et al. | E03F 7/04 |
| 2011/0030132 | A1 | 2/2011 | Biro | |

* cited by examiner

*Primary Examiner* — Kevin Lee
(74) *Attorney, Agent, or Firm* — Pauley Erickson & Kottis

(57) ABSTRACT

Devices and methods for sewer system cleanouts such as provide increased cross bore safeguard during sewer system cleanouts. A sewer system cleanout safety device includes a housing for placement at a sewer cleanout opening to prevent passage of gas out through the sewer cleanout opening during the sewer system cleanout. The housing includes opposed inner and outer cleanout opening surfaces, and a peripheral surface extending between said inner and outer cleanout opening surfaces. The housing includes a cavity extending between the inner and outer cleanout opening surfaces to permit passage of a sewer system cleanout implement therethrough. The housing further includes a cavity lining surface to seal with the sewer system cleanout implement passing therethrough.

18 Claims, 8 Drawing Sheets

DEVICES FOR CROSS BORE SAFEGUARD DURING SEWER SYSTEM CLEANOUTS

BACKGROUND OF THE INVENTION

Field of the Invention

This application relates generally to sewer system cleanout and, more particularly, to devices and methods to provide cross bore safeguard during sewer system cleanouts.

Discussion of Related Art

A "sewer cross bore" is a term used to refer to an inadvertent placement of a gas main or service through a sewer line. Such a cross bore most commonly occurs during trenchless construction. Further, such a cross bore may create or result in a sewer line blockage.

In sewer system cleanouts, a sewer system cleanout implement such as in the form of a cable, rod or the like, for example, and such as introduced into the sewer system such as via cleanout opening provided in the system, is commonly employed to produce, provide or result in desired sewer system clearing or cleaning. In the case of a sewer cross bore, however, either or both the introduction and manipulation of such a sewer system cleanout implement in an effort to clear an unknown sewer obstruction can result in damage to the gas line such as could resulting in an explosion or fire. Further a damaged gas line could release natural gas such as could pass back via the sewer line and be discharged via an opened sewer cleanout opening such as into the house or the building structure associated with the sewer cleanout opening.

In the absence or with the lack of effective safeguards for openings, workers have frequently or commonly resorted to stuffing cleanout openings with rags, towels or the like in an effort to obstruct the opening during a system cleanout.

With the growing or increasing use of trenchless installation for natural gas mains or service, there has been a growing need and desirability for safeguards in the event of cross boring of a sewer main or lateral during such or similar installations.

More particularly, there is a need and a demand for devices and methods that permit the safe processing and operation of sewer system clearing operations to occur even in the event that a natural gas line (inadvertently installed in or at least partially through a sewer line) is struck such as by a power auger or other mechanical tool and natural gas starts enters into the building structure through the cleanout pipe.

SUMMARY OF THE INVENTION

The invention is generally directed to devices and methods directed to providing cross bore safeguard during sewer system cleanouts.

In accordance with one aspect of the invention, there is provided a sewer system cleanout safety device for cross bore safeguard during sewer system cleanout. More particularly, one such safety device desirably includes a housing for placement at a sewer cleanout opening to prevent passage of gas out through the sewer cleanout opening during the sewer system cleanout. Such a housing includes opposed inner and outer cleanout opening surfaces and a peripheral surface extending between said inner and outer cleanout opening surfaces. The housing has a cavity that extends between the inner and outer cleanout opening surfaces to permit passage of a sewer system cleanout implement therethrough. The housing further has a cavity lining surface to seal with the sewer system cleanout implement passing therethrough.

A sewer system cleanout safety device for cross bore safeguard during sewer system cleanout in accordance with another aspect of the invention includes a housing for placement at a sewer cleanout opening to prevent passage of gas out through the sewer cleanout opening during the sewer system cleanout. The housing includes joinable first and second housing parts. The first and second housing parts each desirably have or include opposed housing part inner and outer cleanout opening surfaces and a peripheral surface extending between the housing part inner and outer cleanout opening surfaces. The joining together of the first and second housing parts forms a cavity extending between the inner and outer cleanout opening surfaces to permit passage of a sewer system cleanout implement therethrough.

A sewer system cleanout safety device for cross bore safeguard during sewer system cleanout in accordance with another aspect of the invention includes an at least partially inflatable housing for placement at a sewer cleanout opening to prevent passage of gas out through the sewer cleanout opening during the sewer system cleanout. The housing has opposed inner and outer cleanout opening surfaces and a peripheral surface extending between said inner and outer cleanout opening surfaces. The housing further has, forms or includes a cavity extending between the inner and outer cleanout opening surfaces to permit passage of a sewer system cleanout implement therethrough. The cavity desirably has or includes a lining surface effective to seal with the sewer system cleanout implement passing through the cavity. The housing also has, forms or includes an installation gap opening extending between the cavity and an outer portion of the peripheral surface. A retaining cuff is desirably disposed about a portion of the housing such as to retain the housing at the sewer cleanout opening during cleanout processing and to seal against gas passage thereat.

In accordance with another aspect of the invention, a method for cross bore safeguard during sewer system cleanout is provided. Such a method involves installing a sewer system cleanout safety device at a sewer cleanout opening to prevent passage of gas out through the sewer cleanout opening during the sewer system cleanout.

In particular embodiments, such methods may involve installation of a sewer system cleanout safety device such as including a housing having opposed inner and outer cleanout opening surfaces; a peripheral surface extending between the inner and outer cleanout opening surfaces; and a cavity extending between the inner and outer cleanout opening surfaces to permit passage of a sewer system cleanout implement therethrough, with the housing having a cavity lining surface to seal with the sewer system cleanout implement passing therethrough.

DETAILED DESCRIPTION OF THE INVENTION

Figure 1:
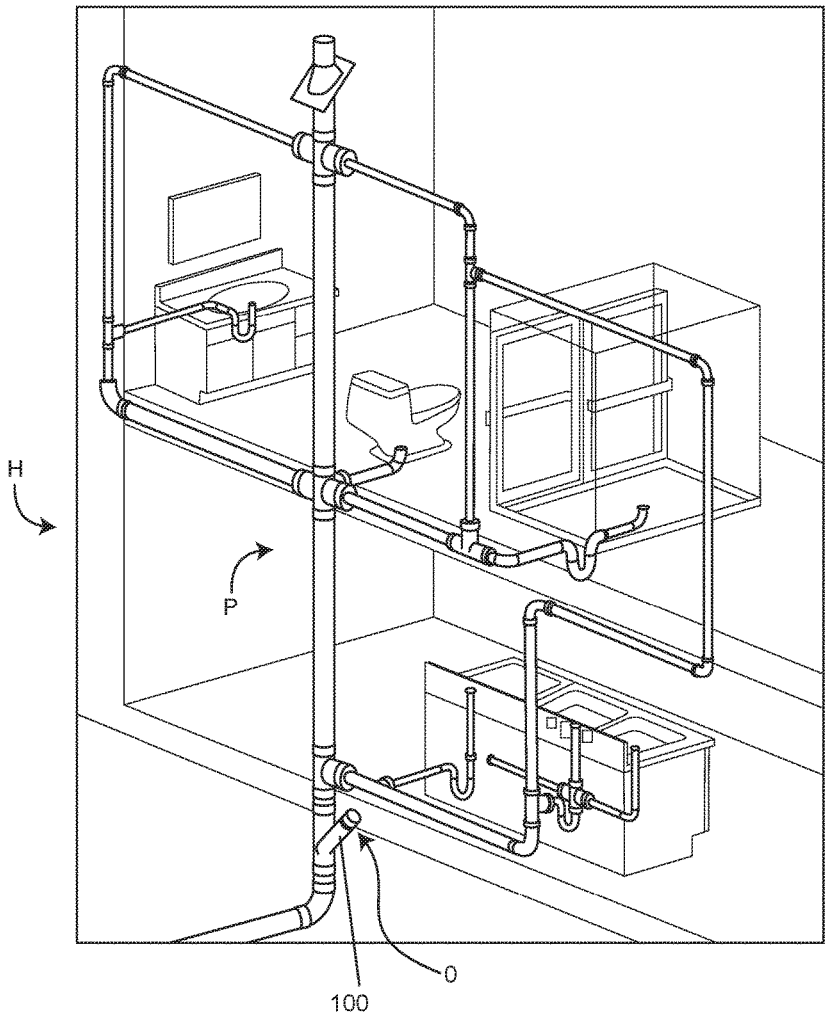
FIG. 1 is a simplified sectional perspective view of a house showing the piping arrangement of the house including a sewer system cleanout.
Figure 2:
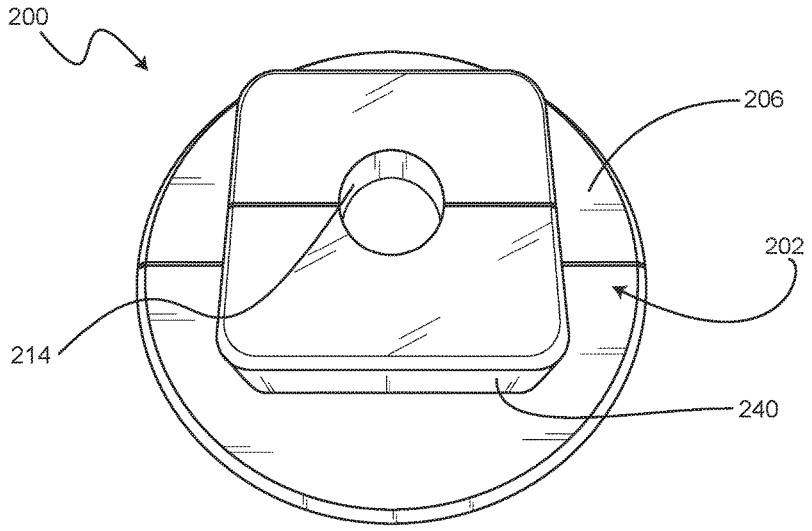
FIG. 2 is a top angled perspective view of a sewer system cleanout safety device in accordance with one embodiment of the invention.
Figure 3:
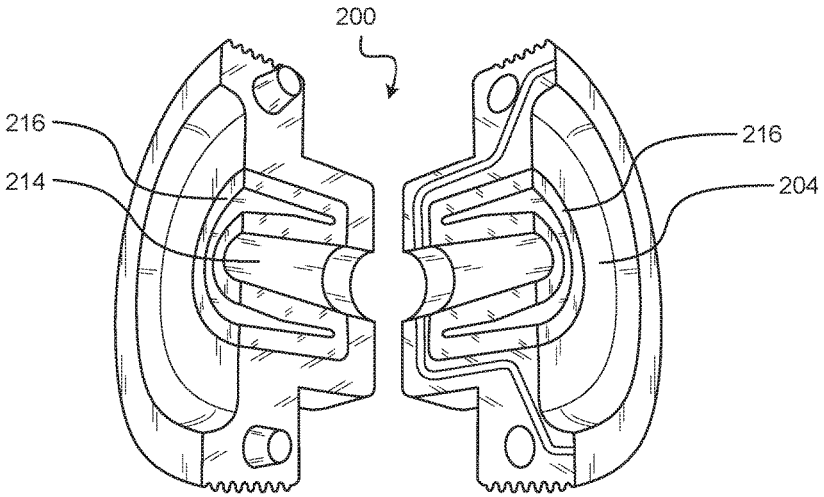
FIG. 3 is a bottom angled perspective view illustrating the sewer system cleanout safety device shown in FIG. 2 with the first and second housing parts disjoined.

Referring to the drawings, FIG. 1 illustrates a house H showing the piping arrangement P of the house including a sewer system cleanout opening O.

As shown, the piping arrangement P may desirably serve to connect various housing components or elements including, for example, sinks, commodes and the like. As will be appreciated, various housing piping arrangements are possible and the broader practice of the invention is not necessarily limited or restricted to that shown in this figure.

The invention, in accordance with one aspect, involves a device, sometimes herein referred to or identified as a sewer system cleanout safety device, schematically shown in FIG. 1 and identified as element 100, and such as disposed on or at the sewer system cleanout opening O. As further detailed below, the sewer system cleanout safety device 100 desirably provides or at least in part serves to provide cross bore safeguard during sewer system cleanout. For example, the proper inclusion of such a safety device can desirably serve to minimize and preferably avoid possibly harmful natural gas from accidentally entering the building structure through the cleanout pipe.

Turning to FIGS. 2-8 various views or aspects of a sewer system cleanout safety device, generally designated by the reference numeral 200, are shown in greater detail. The sewer system cleanout safety device 200 includes a housing 202 for placement at a sewer cleanout opening to prevent passage of gas out through the sewer cleanout opening during the sewer system cleanout. The housing has, includes or forms an inner cleanout opening surface 204 and a generally opposed outer cleanout opening surface 206, where such references to inner and outer are in general reference to the disposition, position or location of such surface when the device has been appropriately placed at a sewer system cleanout opening. That is, the inner cleanout opening surface 204 is in operation typically disposed as appropriately on, adjacent or facing the sewer cleanout opening, with the outer cleanout opening surface 206 generally facing opposite or away from the sewer cleanout opening.

While the device inner and outer cleanout opening surface 204 and 206 have been shown as being generally planar, those skilled in the art and guided by the teachings herein provided will understand and appreciate that the broader practice of the invention is not necessarily so limited. For example, the invention can, if desired, be practices employing such a device wherein either or both the inner and the outer surface is of a desired non-planar form.

The housing 202 further has or includes an outer peripheral surface generally designated 208 and generally extending between the inner and outer cleanout opening surfaces 204 and 206. In operation and in accordance with one embodiment, the safety device housing peripheral surface desirably seals with the sewer cleanout opening. To that end, the housing 202 of the sewer system cleanout safety device 200 includes threading 210 disposed about the peripheral surface 208 such at permit the safety device 200 to be threadingly joined at or with a sewer cleanout opening. Those skilled in the art and guided by the teachings herein provided will, however, understand and appreciate that the broader practice of the invention is not necessarily so limited and, if desired, other appropriate methods or techniques can be used to appropriately position and, if desired, attach or fasten a safety device such as herein described with or to a sewer cleanout opening.

Figure 9:
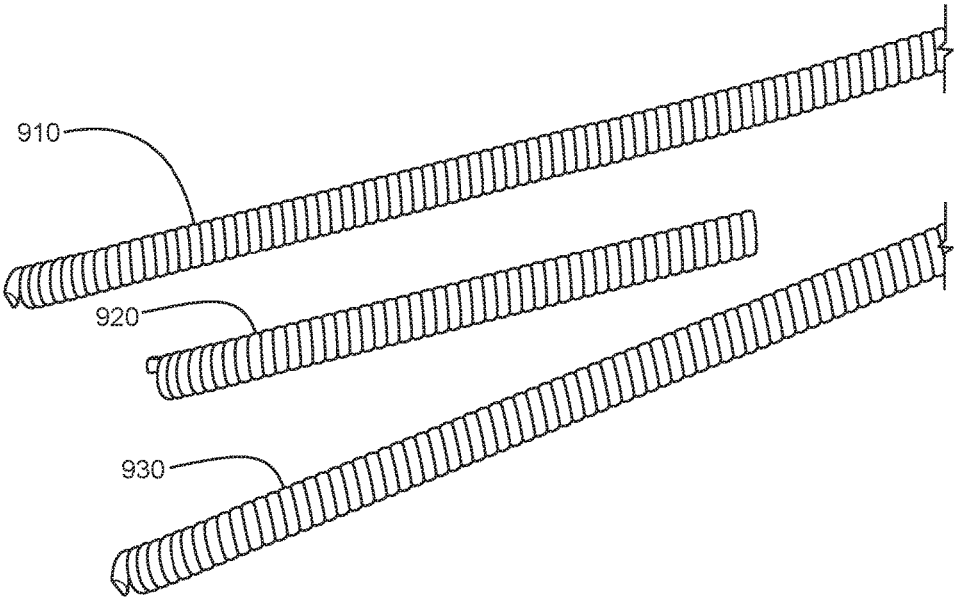
FIG. 9 is a perspective view of sections of several cable or rod sewer system cleanout implements such as useable in accordance with one aspect of the invention with a sewer system cleanout safety device, such as herein provided.

The housing 202 further has, includes or forms a cavity 214 such as extending between the inner cleanout opening surface 204 and the outer cleanout opening surface 206. The cavity desirably can serve to permit the passage of a selected appropriate sewer system cleanout implement therethrough. The housing cavity 214 desirably has a lining surface 216 that includes or otherwise appropriately provides a seal with a sewer system cleanout implement passing through the cavity. For example, as perhaps more clearly seen by reference to FIGS. 3, 5, and 6, the cavity lining 216 can at least in part be formed of or by a material such as rubber overmoulding, for example, such as to effect such a seal. While the broader practice of the invention is not necessarily limited to use or practice with specific or particular forms of sewer system cleanout implements, a commonly utilized sewer system cleanout implement is in the shape or form of a cable or rod, such as sometimes more commonly referred to as a "plumber's snake." FIG. 9 illustrates sections of several cable or rod sewer system cleanout implements 910, 920, and 930 such as useable in accordance with one aspect of the invention with a sewer system cleanout safety device, such as herein provided.

Figure 5:
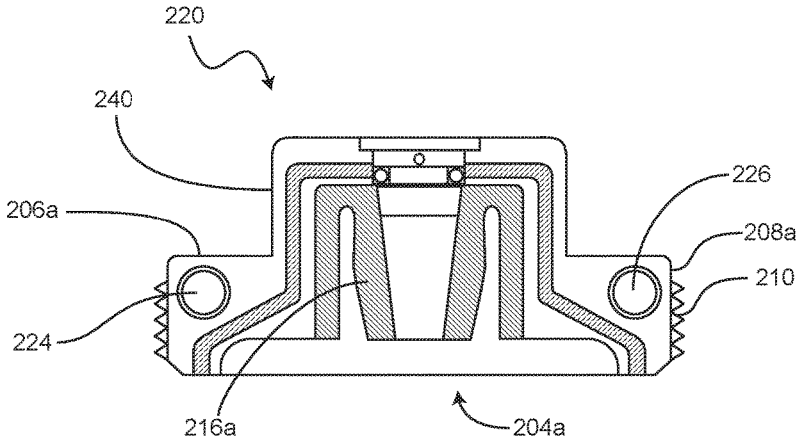
FIGS. 5 and 6 are sectional views of the first and second housing parts, respectively, of the sewer system cleanout safety device shown in FIG. 2.
Figure 6:
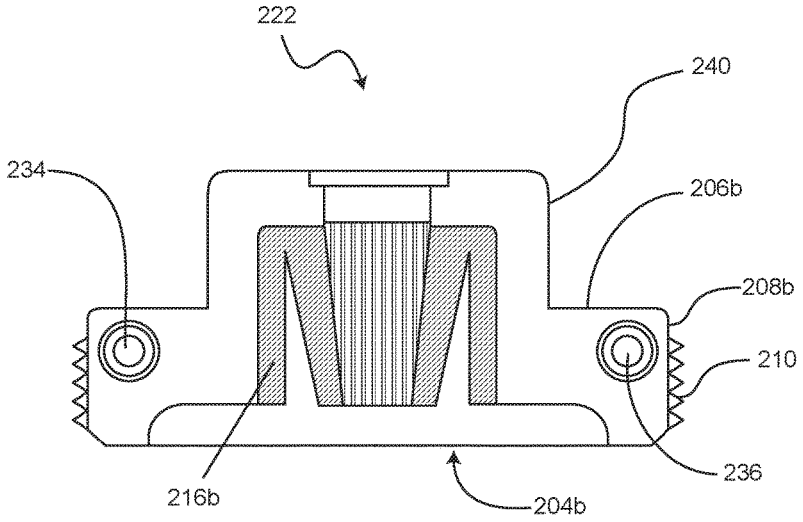

Now referring to the housing 202 in greater detail, making more specific reference to FIGS. 5 and 6, such a housing is comprised of joinable first and second housing parts, 220 and 222. The first housing part 220 has or includes an inner cleanout opening surface 204*a*, an outer cleanout opening surface 206*a*, an outer peripheral surface 208*a* and a cavity lining surface 216*a*. The second housing part 222 similarly or corresponding has or includes an inner cleanout opening surface 204*b*, an outer cleanout opening surface 206*b*, an outer peripheral surface 208*b* and a cavity lining surface 216*b*.

In the housing 202, the first and second housing parts, 220 and 222, are joinable via magnets 224 and 226, such as appropriately disposed in the first housing part 220, and steel dowels 234 and 236, such as appropriately disposed in the second housing part 222. Those skilled in the art and guided by the teaching herein provided will however understand and appreciate that various form or means of attachment or joinder can be utilized to join two or more housing component parts together and that the broader practice of the invention is not necessarily limited or restricted to the use of or practice with magnets to attach or join housing parts.

In the safety device 200, the housing 202 provides or forms a grip protrusion 240 such as outwardly extends from the outer cleanout opening surface 206. The grip protrusion 240 desirably can facilitate gripping and manipulation of the safety device 200 such as during a process of rotating the housing 202 when in the process of threadingly joining the safety device 200 to the sewer cleanout opening.

While the safety device 200 is shown wherein the grip protrusion 240 is formed on the joinder of the first and second housing parts, 220 and 222, the broader practice of the invention is not necessarily so limited. A wide variety of embodiments are envisioned and are herein encompassed, including alternative embodiments such as wherein the safety device: does not include a grip protrusion, includes a grip protrusion disposed or positioned on a single housing body part, includes a grip protrusion not centrally positioned on the device, and includes a grip protrusion of a different shape size, form or material, for example.

The safety device 200 somewhat resembles a typical or common PVC cleanout cap. With the split or two piece housing construction described above and with the two housing parts not yet joined, fastened or connected together, a cleanout cable, rod or the like can be positioned such that the housing parts appropriately wrap round the cable or rod and connect together via the magnets or other selected attachment or connection feature(s). The safety device can then be pushed and advanced towards the threads on a sewer cleanout opening, e.g., an Y-fitting, and screwed in place.

Figure 4:
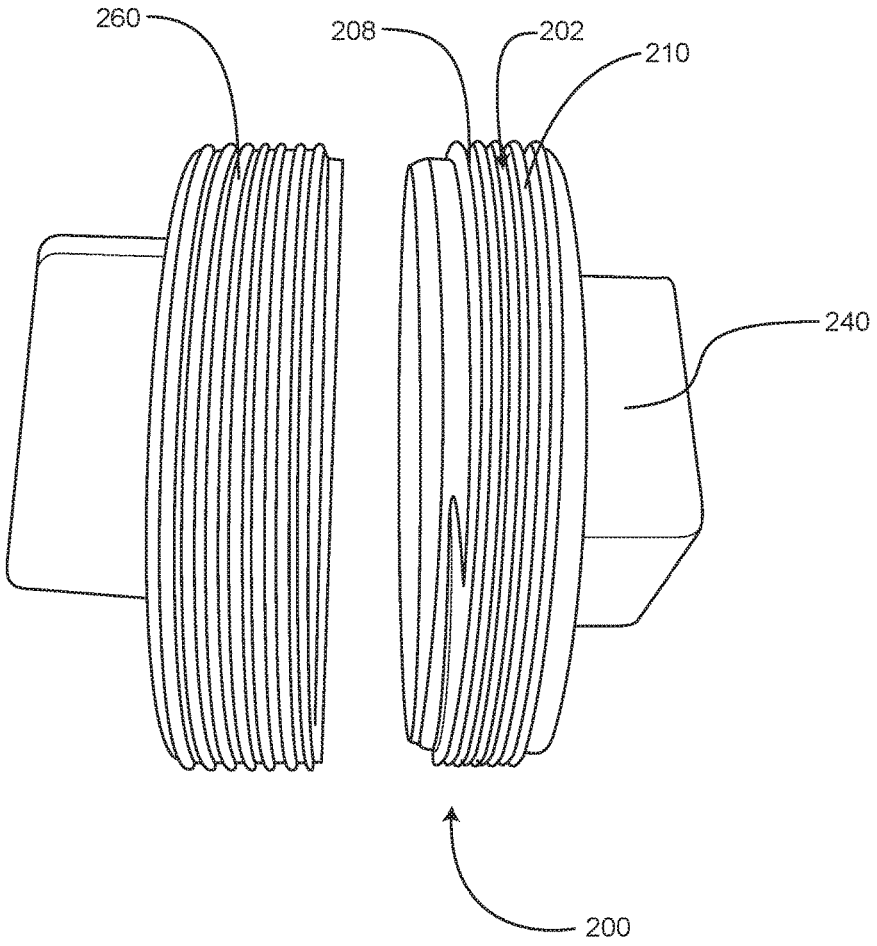
FIG. 4 is a side perspective view of the sewer system cleanout safety device shown in FIG. 2 together with an associated storage cover in accordance with one embodiment.
Figure 7:
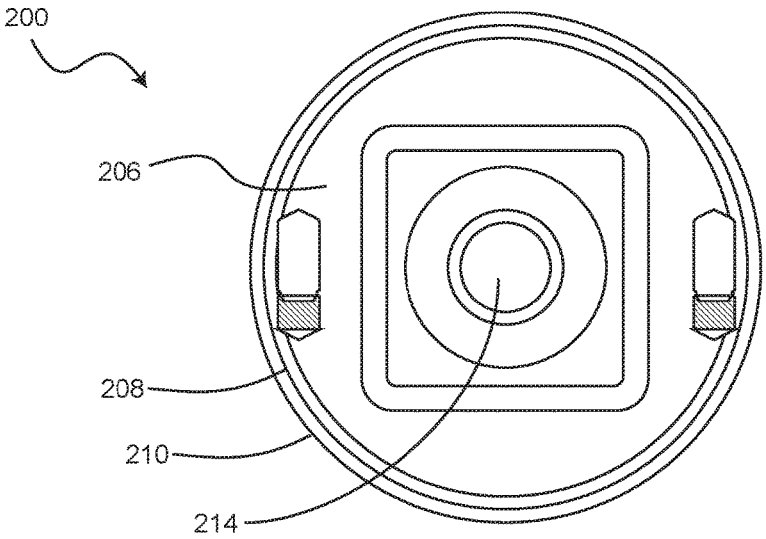
FIGS. 7 and 8 are top and bottom views, respectively, of the sewer system cleanout safety device shown in FIG. 2.
Figure 8:
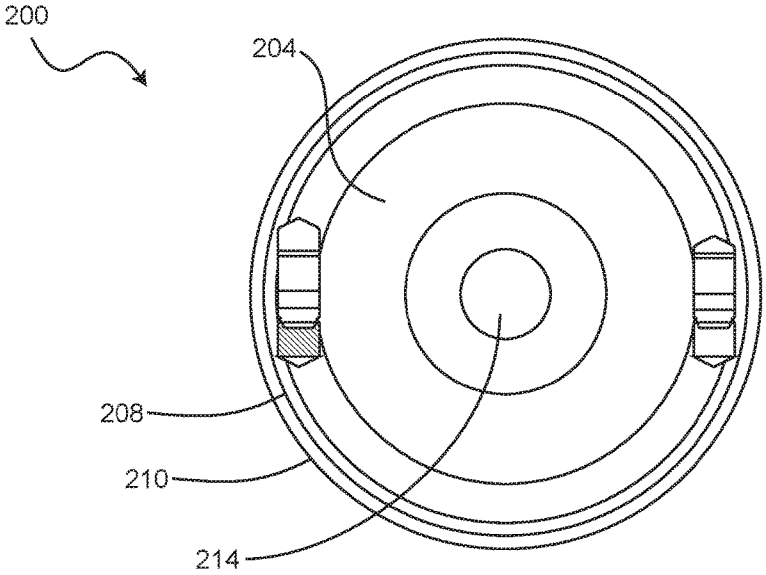

Further, if desired and such as shown in FIG. 4, the safety device 200 can be provided with a storage or transport cover 260 such as designed to fit with the safety device 200 to facilitate and permit the storage or transport of the safety device 200 till such time as the safety device is to be applied to an appropriate sewer cleanout opening.

Figure 10:
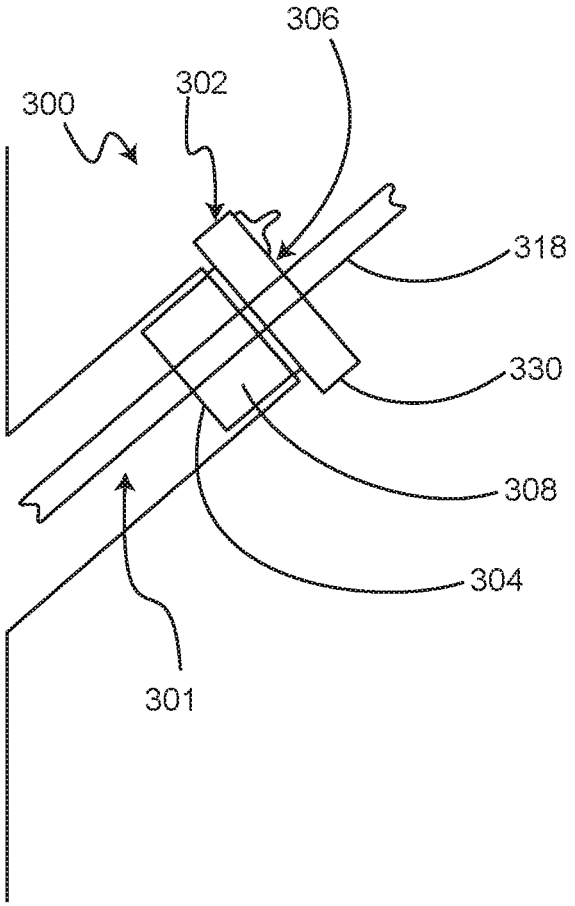
FIG. 10 is a simplified side view of a sewer system cleanout safety device in accordance with another embodiment of the invention.
Figure 11:
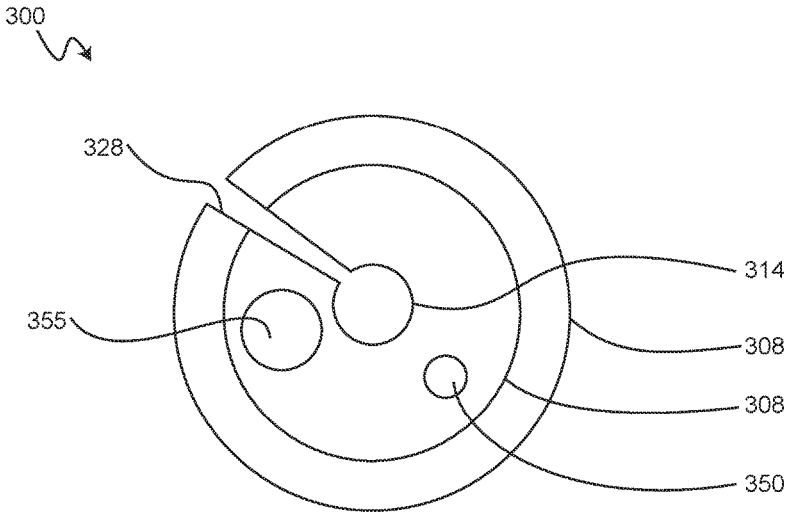
FIGS. 11 and 12 are simplified top and side views, respectively, of the sewer system cleanout safety device shown in FIG. 10.
Figure 12:
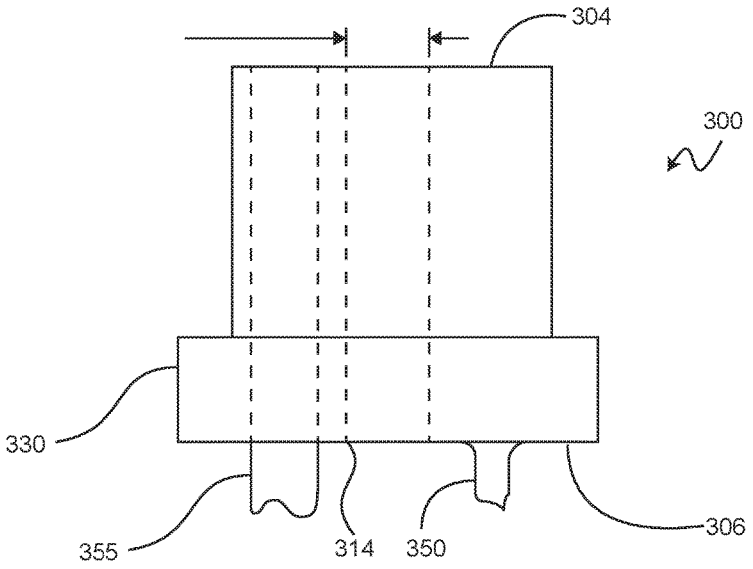

Turning to FIGS. 10-12 there is shown a sewer system cleanout safety device, generally designated by the reference numeral 300, in accordance with another embodiment of the invention.

In FIG. 10, the sewer system cleanout safety device 300 is shown attached, positioned or otherwise appropriately disposed at or on a sewer cleanout opening 301.

The sewer system cleanout safety device 300, similar to the sewer system cleanout safety device 200 described above, includes a housing 302 for placement at a sewer cleanout opening to prevent passage of gas out through the sewer cleanout opening during the sewer system cleanout. The housing 302 has, includes or forms an inner cleanout opening surface 304, a generally opposed outer cleanout opening surface 306 and an outer peripheral surface 308 generally extending between the inner and outer cleanout opening surfaces 304 and 306. The housing 302 further has, includes or forms a cavity 314 such as extending between the inner cleanout opening surface 304 and the outer cleanout opening surface 306. As in the above-described embodiment, the cavity 314 desirably can serve to permit the passage therethrough of a selected appropriate sewer system cleanout implement, such as described above, for example, and such as shown in FIG. 10 as a cable or rod 318.

The housing 302, however, differs from the housing 202 in at least a couple of significant aspects. First, the housing 302 is at least partially inflatable. To that end the housing 302 is desirably formed, manufactured or constructed at least in part of a suitable inflatable material such as or similar to an inflatable rubber tube or the like. The housing 302 further includes or has formed therein an installation gap opening 328 extending between the cavity 314 and an outer portion of the peripheral surface 308. In one preferred embodiment, the installation gap opening 328 desirably narrows and closes upon the proper inflation of the housing 302.

In such an embodiment, the inflatable housing 302 can act or serve as an expandable bladder that seals between the cleanout opening 301 as well as about or around the cable or rod 318 such as of a clearing drill (not shown).

As perhaps best appreciated by reference to FIGS. 10 and 12, the safety device 300 further has or includes a mechanical fitting such as in the form of a retaining cuff 330 such as disposed about at least a portion of the housing 302, such as at or about at least a portion of the outer peripheral surface 308, and such as can desirably serve to appropriately retain the housing 302 at a sewer cleanout opening during cleanout processing and to seal against gas passage thereat. Further, the retaining cuff 330 while fitting the cleanout opening 301 can desirably permit or allow free movement of the drill cable or rod 318. Those skilled in the art and guided by the teachings herein provided will understand and appreciate that other forms or types of mechanical fittings are envisioned and are herein encompassed.

The housing further includes a fill port 350 to permit input of inflation gas into the inflatable housing 302.

As will be appreciated the housing 302 may if desired further include, if desired, one or more optional features such as an optional rigid vent 355 such as extending between the inner and outer cleanout opening surfaces, 304 and 306.

Thus, the invention provides a safety device and related methods such that allow or permit sewer system clearing operations to occur with the ability to seal the sewer system cleanout opening in the event a natural gas line (inadvertently installed in a sewer) is struck by a power auger or other mechanical tool and natural gas enters into the building structure through the cleanout pipe. This subject safety devices and related methods can desirably serve to allow or permit a plumber and/or residents to leave or evacuate a house safely by minimizing/eliminating the release or discharge of natural gas into the house through the sewer cleanout.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A sewer system cleanout safety device for cross bore safeguard during sewer system cleanout, said safety device comprising:

a housing for placement at a sewer cleanout opening to prevent passage of gas out through the sewer cleanout opening during the sewer system cleanout, the housing having opposed inner and outer cleanout opening surfaces, and a peripheral surface extending between said inner and outer cleanout opening surfaces, and the housing having a cavity extending between said inner and outer cleanout opening surfaces to permit passage of a sewer system cleanout implement therethrough, the housing having a cavity lining surface to seal with the sewer system cleanout implement passing therethrough.

2. The safety device of claim 1 wherein the sewer system cleanout implement comprises a cable rod.

3. The safety device of claim 1 wherein the cavity is centrally disposed within the housing.

4. The safety device of claim 1 wherein said peripheral surface seals with the sewer cleanout opening.

5. The safety device of claim 4 wherein;

the housing comprises joinable first and second housing parts, the first and second housing parts each having opposed housing part inner and outer cleanout opening surfaces and a peripheral surface extending between said housing part inner and outer cleanout opening surfaces, wherein the joined together first and second housing parts form said cavity.

6. The safety device of claim 5 wherein the first and second housing parts are magnetically joinable.

7. The safety device of claim 5 wherein the first and second housing parts each include a threaded outer peripheral surface for threaded joining of the safety device to the sewer cleanout opening.

8. The safety device of claim 5 wherein the first and second housing parts each include housing part inner cleanout opening surfaces comprising a sealing material to sealingly cooperate with the sewer system cleanout implement passing therethrough.

9. The safety device of claim 1 wherein:

the housing is at least partially inflatable and further comprises an installation gap opening extending between the cavity and an outer portion of the peripheral surface and the safety device further comprises a retaining cuff disposed about a portion of the housing to retain the housing at the sewer cleanout opening during cleanout processing and to seal against gas passage thereat.

10. The safety device of claim 9 wherein the housing further comprises a rigid vent opening extending between said inner and outer cleanout opening surfaces.

11. The safety device of claim 9 wherein the housing further comprises a fill port to permit input of inflation gas into the inflatable housing.

12. A sewer system cleanout safety device for cross bore safeguard during sewer system cleanout, said safety device comprising:

a housing for placement at a sewer cleanout opening to prevent passage of gas out through the sewer cleanout opening during the sewer system cleanout, the housing comprising joinable first and second housing parts, the first and second housing parts each having opposed housing part inner and outer cleanout opening surfaces and a peripheral surface extending between said housing part inner and outer cleanout opening surfaces, wherein the joined together first and second housing parts form a cavity extending between said inner and outer cleanout opening surfaces to permit passage of a sewer system cleanout implement therethrough.

13. The safety device of claim 12 wherein the first and second housing parts are magnetically joinable.

14. The safety device of claim 12 wherein the first and second housing parts each include:

a threaded outer peripheral surface for threaded joining of the safety device to the sewer cleanout opening and housing part inner cleanout opening surfaces comprising a sealing material to sealingly cooperate with the sewer system cleanout implement passing therethrough.

15. The safety device of claim 14 wherein the first and second housing parts on being joined together form a grip protrusion outwardly extending from the outer cleanout opening surfaces, the grip protrusion permitting gripping of the safety device for rotation whereby the threaded outer peripheral surface is threadingly joins the safety device to the sewer cleanout opening.

16. A sewer system cleanout safety device for cross bore safeguard during sewer system cleanout, said safety device comprising:

an at least partially inflatable housing for placement at a sewer cleanout opening to prevent passage of gas out through the sewer cleanout opening during the sewer system cleanout, the housing having opposed inner and outer cleanout opening surfaces, and a peripheral surface extending between said inner and outer cleanout opening surfaces, the housing having a cavity extending between said inner and outer cleanout opening surfaces to permit passage of a sewer system cleanout implement therethrough, the housing having a cavity lining surface to seal with the sewer system cleanout implement passing therethrough, the housing further comprising an installation gap opening extending between the cavity and an outer portion of the peripheral surface and the safety device further comprises a retaining cuff disposed about a portion of the housing to retain the housing at the sewer cleanout opening during cleanout processing and to seal against gas passage thereat.

17. The safety device of claim 16 wherein the housing further comprises a rigid vent opening extending between said inner and outer cleanout opening surfaces.

18. The safety device of claim 16 wherein the housing further comprises a fill port to permit input of inflation gas into the inflatable housing.

* * * * *